US008613829B2

(12) United States Patent
Anderson et al.

(10) Patent No.: US 8,613,829 B2
(45) Date of Patent: Dec. 24, 2013

(54) ANTI-MICROBIAL PAPER SUBSTRATES USEFUL IN WALLBOARD TAPE APPLICATIONS

(75) Inventors: Dennis W. Anderson, Goshen, OH (US); Bianca A. Morganroth, Cincinnati, OH (US); William A. Payne, Cordova, TN (US)

(73) Assignee: International Paper Company, Memphis, TN (US)

( * ) Notice: Subject to any disclaimer, the term of this patent is extended or adjusted under 35 U.S.C. 154(b) by 0 days.

(21) Appl. No.: 12/833,344

(22) Filed: Jul. 9, 2010

(65) Prior Publication Data

US 2011/0024067 A1 Feb. 3, 2011

Related U.S. Application Data

(63) Continuation of application No. PCT/US2010/038919, filed on Jun. 16, 2010.

(60) Provisional application No. 61/187,302, filed on Jun. 16, 2009.

(51) Int. Cl.

| | |
|---|---|
| ***D21H 17/28*** | (2006.01) |
| ***D21H 17/62*** | (2006.01) |
| ***D21H 21/16*** | (2006.01) |
| ***D21H 21/36*** | (2006.01) |

(52) U.S. Cl.

USPC ..... 162/161; 162/135; 162/158; 162/184; 106/15.05; 106/163.01; 106/206.1; 106/215.2; 106/219; 106/243

(58) Field of Classification Search

USPC ..... 162/135, 158, 1, 61, 184; 106/15.05, 106/162.1, 163.01, 206.1, 215.2, 218, 219, 106/243

See application file for complete search history.

(56) References Cited

U.S. PATENT DOCUMENTS

| | | | |
|---|---|---|---|
| 1,650,425 | A | 11/1927 | Burgess Roy |
| 2,913,104 | A | 11/1959 | Parker |

(Continued)

FOREIGN PATENT DOCUMENTS

| | | |
|---|---|---|
| CN | 1463206 | 12/2003 |
| DE | 142217 | 10/1987 |

(Continued)

OTHER PUBLICATIONS

Smook, "Handbook for Pulp Paper Technologists," Angus Wilde Publications, 1992.

(Continued)

*Primary Examiner* — Yogendra Gupta
*Assistant Examiner* — Dennis Cordray
(74) *Attorney, Agent, or Firm* — Thomas W. Barnes, III; John K. Pike

(57) ABSTRACT

This invention relates to paper products and/or substrates suitable for being made into wallboard tape (also may be known as joint tape and/or drywall tape) and having improved reduction or inhibition in the growth of microbes, mold and/or fungus. The paper substrate is characterized by its excellent physical properties including cross direction (CD) tensile, machine (MD) tensile, internal bond, wet tensile, hygroexpansivity, curl, bonding properties, bonding of joint tape to joint compound, etc. The paper product of the invention contains a sizing agent and an antimicrobial compound as well as other optional components including without limitation a binder. The paper product of the invention may be produced by contacting the plurality of cellulose fibers with each of the sizing agent, antimicrobial compound, and optional components at any point in the papermaking process, converting process, and/or post-converting process. Finally, the invention relates to methods of using the paper substrate.

22 Claims, 10 Drawing Sheets

(56) References Cited

U.S. PATENT DOCUMENTS 3,038,277 A * 6/1962 Cowan ..... 52/417
3,174,874 A 3/1965 Winter et al.
3,293,114 A 12/1966 Kenaga et al.
3,307,306 A 3/1967 Oliver
3,370,957 A 2/1968 Royse et al.
3,533,908 A 10/1970 Hoogsteen
3,556,934 A 1/1971 Meyer
3,560,332 A 2/1971 Crandall et al.
3,729,879 A 5/1973 Franklin
3,857,934 A 12/1974 Bernstein et al.
3,918,981 A * 11/1975 Long ..... 106/16
3,936,339 A 2/1976 Lock et al.
3,976,495 A 8/1976 Buckman et al.
3,998,944 A 12/1976 Long
4,022,965 A 5/1977 Goheen et al.
4,040,900 A 8/1977 Mazzarella et al.
4,075,136 A 2/1978 Schaper
4,111,712 A 9/1978 Pusch
4,128,434 A 12/1978 Pusch
4,131,638 A 12/1978 Whitaker et al.
4,133,688 A 1/1979 Sack
4,166,894 A 9/1979 Schaper
4,174,417 A 11/1979 Rydell
4,179,546 A 12/1979 Garner et al.
4,184,914 A 1/1980 Jenkins
4,216,296 A 8/1980 Wernsing
4,279,794 A 7/1981 Dumas
4,323,602 A 4/1982 Parker
4,413,586 A 11/1983 Wohrle
4,431,481 A 2/1984 Drach et al.
4,444,847 A 4/1984 Fujioka et al.
4,448,807 A 5/1984 Serlin
4,483,889 A 11/1984 Andersson
4,496,427 A 1/1985 Davison
4,529,654 A 7/1985 Drum
4,533,435 A 8/1985 Intili et al.
4,629,645 A 12/1986 Inoue
4,709,523 A 12/1987 Broderick et al.
4,710,422 A 12/1987 Fredenucci
4,753,710 A 6/1988 Langley et al.
4,850,948 A 7/1989 Schmitz
4,986,882 A 1/1991 Mackey et al.
5,011,741 A 4/1991 Hoffman
5,017,416 A 5/1991 Imperial et al.
5,049,235 A 9/1991 Barcus et al.
5,087,457 A 2/1992 Bryant et al.
5,125,996 A 6/1992 Campbell
5,133,835 A 7/1992 Goettmann et al.
5,160,789 A 11/1992 Barcus et al.
5,209,953 A 5/1993 Grupe et al.
5,219,875 A 6/1993 Sherba et al.
5,266,250 A 11/1993 Kroyer
5,318,219 A 6/1994 Smith
5,342,649 A 8/1994 Sarokin
5,360,420 A 11/1994 Cook et al.
5,415,923 A 5/1995 Sarokin et al.
5,443,899 A 8/1995 Barcus et al.
5,464,622 A 11/1995 Mehta et al.
5,472,757 A 12/1995 Ogawa et al.
5,514,429 A 5/1996 Kamiharaguchi et al.
5,527,430 A 6/1996 Gill
5,531,728 A 7/1996 Lash
5,542,541 A 8/1996 Smith
5,662,773 A 9/1997 Frederick et al.
5,667,637 A 9/1997 Jewell et al.
5,681,851 A 10/1997 Lee et al.
5,685,815 A 11/1997 Bottorff et al.
5,698,074 A 12/1997 Barcus et al.
5,698,688 A 12/1997 Smith et al.
H1704 H 1/1998 Wallajapet et al.
5,709,976 A 1/1998 Malhotra
5,731,080 A 3/1998 Cousin et al.
5,766,395 A 6/1998 Bainbridge et al.
5,766,417 A 6/1998 Brungardt
5,776,619 A 7/1998 Shanton
5,817,180 A 10/1998 Ferguson et al.
5,817,214 A * 10/1998 Sasaki et al. ..... 162/180
5,840,245 A 11/1998 Coombs et al.
5,840,413 A 11/1998 Kajander
5,848,509 A 12/1998 Knapp et al.
5,856,389 A 1/1999 Kostrzewski et al.
5,882,731 A 3/1999 Owens
5,885,340 A 3/1999 Bailey et al.
5,908,723 A 6/1999 Malhotra et al.
5,938,825 A 8/1999 Gaglani et al.
5,942,288 A 8/1999 Kajander
5,952,051 A 9/1999 Asano et al.
5,985,076 A 11/1999 Misuda et al.
6,007,906 A 12/1999 Bottorff et al.
6,022,816 A 2/2000 Dewar
6,033,526 A 3/2000 Ehrhardt et al.
6,034,081 A 3/2000 Whittemore et al.
6,048,575 A 4/2000 Altavilla
6,059,991 A 5/2000 Gaglani et al.
6,087,457 A 7/2000 Tsai
6,126,783 A 10/2000 Gill
6,146,494 A 11/2000 Seger et al.
6,149,927 A 11/2000 Ghosh
6,165,321 A 12/2000 Pauley et al.
6,171,440 B1 1/2001 Staib
6,183,814 B1 2/2001 Nangeroni et al.
6,187,143 B1 * 2/2001 Juppo et al. ..... 162/158
6,191,057 B1 2/2001 Patel et al.
6,197,805 B1 3/2001 Smith
6,210,767 B1 4/2001 Knauf
6,221,798 B1 4/2001 Mahale et al.
6,228,219 B1 5/2001 Ehrhardt et al.
6,241,994 B1 6/2001 Lee et al.
6,273,997 B1 8/2001 Ehrhardt et al.
6,291,127 B1 9/2001 Dagan et al.
6,316,095 B1 11/2001 Black et al.
6,325,969 B1 12/2001 Aamodt et al.
6,355,137 B1 3/2002 Staib
6,357,504 B1 3/2002 Patel et al.
6,358,576 B1 3/2002 Adur et al.
6,361,651 B1 3/2002 Sun
6,379,497 B1 4/2002 Sandstrom et al.
6,387,500 B1 5/2002 Behl
6,471,824 B1 10/2002 Jewell
6,506,282 B2 1/2003 Hu et al.
6,512,146 B2 1/2003 Pauley et al.
6,579,414 B2 6/2003 Jewell
6,579,415 B2 6/2003 Jewell
6,582,557 B2 6/2003 Jewell
6,592,712 B2 7/2003 Koukoulas et al.
6,592,717 B2 7/2003 Jewell
6,595,632 B1 7/2003 Storfer-Isser et al.
6,645,642 B2 11/2003 Kulkarni et al.
6,797,653 B2 9/2004 Fay
6,802,938 B2 10/2004 Mohan et al.
6,846,529 B2 1/2005 Froass et al.
6,901,711 B2 6/2005 Fay et al.
6,939,442 B2 9/2005 Klimpl et al.
6,951,962 B2 10/2005 Bottorff
7,279,071 B2 10/2007 Williams et al.
7,666,272 B2 2/2010 Williams et al.
7,666,273 B2 2/2010 Williams et al.
7,794,850 B2 9/2010 Kulkarni et al.
7,927,458 B2 4/2011 Williams et al.
2001/0011466 A1 8/2001 Arterburn et al.
2001/0015118 A1 8/2001 Bascom et al.
2001/0021448 A1 9/2001 Kajander
2001/0033926 A1 10/2001 Matthews et al.
2001/0050139 A1 12/2001 Vair, Jr. et al.
2001/0054476 A1 12/2001 Vair, Jr. et al.
2002/0005263 A1 1/2002 Smith, Jr.
2002/0040088 A1 4/2002 Hauschel et al.
2002/0040556 A1 4/2002 Weinstein et al.
2002/0078648 A1 6/2002 Cunningham et al.
2002/0083671 A1 7/2002 Clausen et al.
2002/0091185 A1 7/2002 Taylor et al.
2002/0096294 A1 7/2002 Nicholass et al.
2002/0100246 A1 8/2002 Williamson et al.
2002/0127399 A1 9/2002 Mankell et al.

(56) References Cited

U.S. PATENT DOCUMENTS

| | | | | |
|---|---|---|---|---|
| 2002/0182381 | A1 | 12/2002 | Kulkarni et al. | |
| 2002/0185239 | A1 | 12/2002 | Kimpimaki et al. | |
| 2003/0008093 | A1 | 1/2003 | Ray et al. | |
| 2003/0008586 | A1 | 1/2003 | Kajander et al. | |
| 2003/0037502 | A1 | 2/2003 | Bruce et al. | |
| 2003/0044314 | A1 | 3/2003 | Aamodt et al. | |
| 2003/0108761 | A1 | 6/2003 | Eddlemon | |
| 2003/0113526 | A1 | 6/2003 | Jaffee | |
| 2003/0132425 | A1 | 7/2003 | Curzon et al. | |
| 2003/0139111 | A1 | 7/2003 | Kajander et al. | |
| 2003/0148686 | A1 | 8/2003 | Weinstein et al. | |
| 2003/0156974 | A1 | 8/2003 | Haas et al. | |
| 2003/0167889 | A1 | 9/2003 | Bascom et al. | |
| 2003/0167891 | A1 | 9/2003 | Bascom et al. | |
| 2003/0170317 | A1 | 9/2003 | Curzon et al. | |
| 2003/0173436 | A1 | 9/2003 | Bascom et al. | |
| 2003/0205067 | A1 | 11/2003 | Arterburn | |
| 2003/0234068 | A1 | 12/2003 | Swofford et al. | |
| 2004/0013884 | A1 | 1/2004 | Plotz | |
| 2004/0109971 | A1 | 6/2004 | Weinstein et al. | |
| 2004/0123966 | A1 | 7/2004 | Altman et al. | |
| 2004/0132364 | A1 | 7/2004 | Wulliman et al. | |
| 2004/0149409 | A1 | 8/2004 | Klimpl et al. | |
| 2004/0182031 | A1 | 9/2004 | Fay et al. | |
| 2004/0185204 | A1 | 9/2004 | Fay et al. | |
| 2004/0185209 | A1 | 9/2004 | Fay et al. | |
| 2004/0185210 | A1 | 9/2004 | Fay et al. | |
| 2004/0185211 | A1 | 9/2004 | Fay et al. | |
| 2004/0185212 | A1 | 9/2004 | Bogrett et al. | |
| 2004/0224176 | A1 | 11/2004 | Hindi et al. | |
| 2004/0247893 | A1 | 12/2004 | Chen | |
| 2006/0008496 | A1* | 1/2006 | Kulkarni et al. | 424/412 |
| 2006/0008513 | A1 | 1/2006 | Holbert et al. | |
| 2006/0035097 | A1 | 2/2006 | Batdorf | |
| 2006/0169431 | A1 | 8/2006 | Marks et al. | |
| 2006/0171976 | A1 | 8/2006 | Weir et al. | |
| 2006/0191656 | A1* | 8/2006 | Buzza et al. | 162/158 |
| 2006/0199454 | A1 | 9/2006 | Blanpied et al. | |
| 2006/0207738 | A1* | 9/2006 | Wild | 162/168.1 |
| 2006/0252849 | A1 | 11/2006 | Rose et al. | |
| 2006/0254170 | A1 | 11/2006 | Goldman | |
| 2007/0048342 | A1* | 3/2007 | Hauber et al. | 424/405 |
| 2007/0082170 | A1* | 4/2007 | Colbert et al. | 428/70 |
| 2007/0113997 | A1* | 5/2007 | Glittenberg | 162/175 |
| 2008/0128070 | A1* | 6/2008 | Goldman | 156/71 |
| 2008/0256886 | A1 | 10/2008 | Goldman | |
| 2010/0092725 | A1 | 4/2010 | Goldman | |
| 2011/0056639 | A1 | 3/2011 | Kulkarni et al. | |

FOREIGN PATENT DOCUMENTS

| | | |
|---|---|---|
| EP | 290115 | 11/1988 |
| EP | 0510225 | 10/1992 |
| EP | 0551893 | 1/1993 |
| EP | 0629741 | 12/1994 |
| EP | 0510225 | 7/1995 |
| EP | 0666368 | 8/1995 |
| EP | 880892 | 12/1998 |
| EP | 1040935 | 10/2000 |
| EP | 1527685 | 5/2005 |
| GB | 786543 | 10/1955 |
| GB | 903416 | 11/1959 |
| GB | 1184563 | 3/1970 |
| GB | 1373788 | 10/1971 |
| GB | 1429319 | 3/1976 |
| GB | 1533434 | 3/1976 |
| GB | 2011837 | 2/1982 |
| GB | 2307487 | 5/1997 |
| JP | 61020798 | 1/1986 |
| JP | 61097204 | 5/1986 |
| JP | 5246164 | 9/1993 |
| JP | 06065897 | 3/1994 |
| JP | 06157215 | 6/1994 |
| JP | 668853 | 9/1994 |
| JP | 06329834 | 11/1994 |
| JP | 08337078 | 12/1996 |
| JP | 10034791 | 2/1998 |
| JP | 2983788 | 9/1999 |
| JP | 2000511239 | 8/2000 |
| JP | 2003201700 | 7/2003 |
| WO | 9745590 | 12/1997 |
| WO | 9852765 | 11/1998 |
| WO | 9916973 | 4/1999 |
| WO | 9963157 | 12/1999 |
| WO | 0044983 | 8/2000 |
| WO | 0194512 | 12/2001 |
| WO | 0207984 | 1/2002 |
| WO | 0248459 | 6/2002 |
| WO | 02084026 | 10/2002 |
| WO | 02085539 | 10/2002 |
| WO | 2006014426 | 2/2006 |
| WO | 2007025734 | 3/2007 |

OTHER PUBLICATIONS

E. Strazdins in the Sizing of Paper, Second Edition, edited by W. F. Reynolds, Tappi Press, 1989, pp. 1-31.

Biocides Face Challenge of Ever Changing Needs 1992; www.icis.com/Articles/1992/01/06/37676/biocides-face-challenge-of-ever-changing-needs.html.

C. E. Farley and R. B. Wasser in the Sizing of Paper, Second Edition, edited by W. F. Reynolds, Tappi Press, 1989, pp. 51-62.

"Technology Review Series Triclosan and Its Impurities," by J. Menoutis, PhD, copyright 1998-2001, publication date 2001; QuantexLaboratories (2 pages).

Mclaughlin et al, Tappi, 40, pp. 146-151, 1957.

* cited by examiner

ANTI-MICROBIAL PAPER SUBSTRATES USEFUL IN WALLBOARD TAPE APPLICATIONS

The present application claims the benefit of priority under 35 USC §119(e) to U.S. Provisional Patent Application 61/187,302 entitled "Anti-michotic Wallboard Tape", filed Jun. 16, 2009, which is hereby incorporated, in its entirety, herein by reference.

FIELD OF THE INVENTION

This invention relates to paper products and/or substrates suitable for being made into wallboard tape (also may be known as joint tape and/or drywall tape) and having improved reduction or inhibition in the growth of microbes, mold and/or fungus. The paper substrate is characterized by its excellent physical properties including cross direction (CD) tensile, machine (MD) tensile, internal bond, wet tensile, hygroexpansivity, curl, bonding properties, bonding of joint tape to joint compound, etc. The paper product of the invention contains a sizing agent and an antimicrobial compound as well as other optional components including without limitation a binder. The paper product of the invention may be produced by contacting the plurality of cellulose fibers with each of the sizing agent, antimicrobial compound, and optional components at any point in the papermaking process, converting process, and/or post-converting process. Finally, the invention relates to methods of using the paper substrate.

BACKGROUND OF THE INVENTION

Wallboard (also known as drywall) has become the dominant material in the production of interior building partitions. In particular, interior building partitions generally comprise a studwall of spaced parallel vertical members (studs) which are used as a support for preformed panels (wallboard) which are attached to the studwall by screws, nails, adhesive or any other conventional attachment system. Obviously, joints exist between adjacent preformed panels. In order to provide a continuous flat surface to the wall, it is necessary to "finish" the joint between adjacent panels. Generally, such "finishing" may include the building up of multiple layers of a mastic material (joint compound) and the blending of this joint compound and paper substrate suitable for wallboard tape utility into the panel surface so as to form the desired flat and contiguous wall surface. In addition, wallboard tape may be used to bring together a plurality of panels forming a corner which may include but is not limited to corner bead.

In order to facilitate this finishing of the joints and/or corners, most manufacturers bevel the longitudinal edges of the wallboard panels so as to allow a build-up of mastic material which will then match the level of the major surface area of the preformed panel. Typically, the buildup of the mastic material in the joint area comprises the application of a first layer of mastic material, the embedding of a wallboard tape (for example a paper tape) in the first layer of mastic material and then the overcoating of the tape with one or more, generally two layers of additional mastic material. This finishing of the joints is a time consuming process, since it is generally necessary to wait 24 hours between each application of a coat of mastic material in order to allow the coat to dry before the application of an overcoat of an additional layer of mastic material. Moreover, it is then necessary generally to sand the joint area so as to produce a finish which will match the major portion of the surface area of the wallboard panels. The "finishing" process thus is both time-consuming and labor-intensive.

In addition to the above, it is desirable to, create building materials that are antimicrobial so that they resist or inhibit the growth of microbes such as bacteria, fungus, molds, and mildew.

Wallboard tape paper is a very challenging paper to make as there is a very narrow window of operation in which to achieve the required high tensile strengths while maintaining other good physical properties such as bonding properties, bonding of joint tape to joint compound, hygroexpansivity, curl, etc. The challenge to the next generation of wallboard tape paper substrate production is to program an addition antimicrobial function into what is already a very specific and stringent set of physical properties such as CD tensile, MD tensile, internal bond, wet tensile, hygroexpansivity, curl, bonding properties, bond of joint tape to joint compound, etc (which are demanded by wallboard tape paper substrate converters and users). Such levels of physical properties such as CD tensile, MD tensile, internal bond, wet tensile, hygroexpansivity, curl, bonding properties, bond of joint tape to joint compound, etc, have been achieved by conventional production of paper substrates under acidic conditions and alkaline conditions. However, an alkaline paper substrate suitable for wallboard tape converting (e.g. have acceptable physical properties such as CD tensile, MD tensile, internal bond, wet tensile, hygroexpansivity, curl, bonding properties, bond of joint tape to joint compound, etc) has been difficult to achieve.

Despite the considerable efforts, there exists a need for a wallboard tape to satisfy the construction industries' requirements wallboard tape having highly sought after physical properties and maintain sustainable antimicrobial properties.

DETAILED DESCRIPTION OF THE INVENTION

Figure 1:
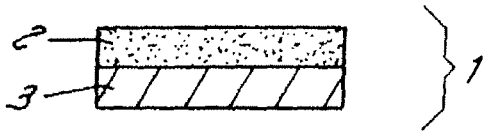
FIG. 1: A first schematic cross section of just one exemplified embodiment of the paper substrate that is included in the paper substrate of the present invention.

The present inventors have now discovered a paper substrate which, until now, was unable to meet the stringent physical properties required by the construction industries for useful wallboard tape application that also has sustainable antimicrobial properties, as well as methods of making and using the same.

The paper substrate of the present invention may contain recycled fibers and/or virgin fibers. Recycled fibers differ from virgin fibers in that the fibers have gone through the drying process at least once.

The paper substrate of the present invention may contain from 1 to 99 wt % of cellulose fibers based upon the total weight of the substrate, including 1, 5, 10, 15, 20, 25, 30, 35, 40, 45, 50, 55, 60, 65, 70, 75, 80, 85, 90, 95 and 99 wt %, and including any and all ranges and subranges therein.

Preferably, the sources of the cellulose fibers are from softwood and/or hardwood. The paper substrate of the present invention may contain from 1 to 99 wt %, preferably from 5 to 95 wt %, cellulose fibers originating from softwood species based upon the total amount of cellulose fibers in the paper substrate. This range includes 5, 10, 15, 20, 25, 30, 35, 40, 45, 50, 55, 60, 65, 70, 75, 80, 85, 90, 95, and 100 wt %, including any and all ranges and subranges therein, based upon the total amount of cellulose fibers in the paper substrate.

The paper substrate of the present invention may contain from 1 to 99 wt %, preferably from 5 to 95 wt %, cellulose fibers originating from hardwood species based upon the total amount of cellulose fibers in the paper substrate. This range includes 5, 10, 15, 20, 25, 30, 35, 40, 45, 50, 55, 60, 65, 70, 75, 80, 85, 90, 95, and 100 wt %, including any and all ranges and subranges therein, based upon the total amount of cellulose fibers in the paper substrate.

Further, the softwood and/or hardwood fibers contained by the paper substrate of the present invention may be modified by physical and/or chemical means. Examples of physical means include, but is not limited to, electromagnetic and mechanical means. Means for electrical modification include, but are not limited to, means involving contacting the fibers with an electromagnetic energy source such as light and/or electrical current. Means for mechanical modification include, but are not limited to, means involving contacting an inanimate object with the fibers. Examples of such inanimate objects include those with sharp and/or dull edges. Such means also involve, for example, cutting, kneading, pounding, impaling, etc means.

Examples of chemical means include, but is not limited to, conventional chemical fiber modification means. Examples of such modification of fibers may be, but is not limited to, those found in the following U.S. Pat. Nos. 6,592,717, 6,582,557, 6,579,415, 6,579,414, 6,506,282, 6,471,824, 6,361,651, 6,146,494, H1,704, 5,698,688, 5,698,074, 5,667,637, 5,662,773, 5,531,728, 5,443,899, 5,360,420, 5,266,250, 5,209,953, 5,160,789, 5,049,235, 4,986,882, 4,496,427, 4,431,481, 4,174,417, 4,166,894, 4,075,136, and 4,022,965, which are hereby incorporated in their entirety by reference.

The paper substrate of the present invention may contain an antimicrobial compound. The paper substrate's antimicrobial tendency may be measured in part by ASTM standard testing methodologies such as D 2020-92, E 2180-01, G 21-966, C1338, and D2020, all of which can be found as published by ASTM and all of which are hereby incorporated, in their entirety, herein by reference.

Antimycotics, fungicides are examples of antimicrobial compounds. Antimicrobial compounds may retard, inhibit, reduce, and/or prevent the tendency of microbial growth over time on/in a product containing such compounds as compared to that tendency of microbial growth on/in a product not containing the antimicrobial compounds. The antimicrobial compound when incorporated into the paper substrate of the present invention preferably retards, inhibits, reduces, and/or prevents microbial growth for a time that is at least 5, 10, 15, 20, 25, 30, 35, 40, 45, 50, 75, 100, 125, 150, 200, 250, 300, 350, 400, 450, 500, 550, 600, 700, 800, 900, 1000% greater than that of a paper substrate that does not contain an antimicrobial compound, including all ranges and subranges therein.

Antimycotic compounds are, in part, mold resistant. Fungicide compounds are, in part, fungus resistant. The antimicrobial compound may have other functions and activities than provide either mold resistance and/or fungus resistance to a product containing the same.

The antimicrobial compound may also be mildew, bacteria and/or virus resistant. A mold specifically targeted, but meant to be non-limiting, is Black mold as applied to the above-mentioned paper substrate of the present invention.

It is preferable for the antimycotic and/or fungicide to not be highly toxic to humans.

The antimycotic and/or fungicide may be water insoluble and/or water soluble, most preferably water insoluble. The antimycotic and/or fungicide may be volatile and/or non-volatile, most preferably non-volatile. The antimycotic and/or fungicide may be organic and/or inorganic. The antimycotic and/or fungicide may be polymeric and/or monomeric.

The antimycotic and/or fungicide may be multivalent which means that the agent may carry one or more active compounds so as to protect against a wider range of mold, mildew and/or fungus species and to protect from evolving defense mechanisms within each species of mold, mildew and/or fungus.

Any water-soluble salt of pyrithione having antimicrobial properties is useful as the antimicrobial compound. Pyrithione is known by several names, including 2 mercaptopyridine-N-oxide; 2-pyridinethiol-1-oxide (CAS Registry No. 1121-31-9); 1-hydroxypyridine-2-thione and 1 hydroxy-2(1H)-pyridinethione (CAS Registry No. 1121-30-8). The sodium derivative, known as sodium pyrithione (CAS Registry No. 3811-73-2), is one embodiment of this salt that is particularly useful. Pyrithione salts are commercially available from Arch Chemicals, Inc. of Norwalk, Conn., such as Sodium OMADINE or Zinc OMADINE.

Examples of the antimicrobial compound may include silver-containing compound, zinc-containing compound, an isothiazolone-containing compound, a benzothiazole-containing compound, a triazole-containing compound, an azole-containing compound, a benzimidazol-containing compound, a nitrile containing compound, alcohol-containing compound, a silane-containing compound, a carboxylic acid-containing compound, a glycol-containing compound, a thiol-containing compound or mixtures thereof.

Additional exemplified commercial antimicrobial compounds may include those from Intace including B-6773 and B-350, those from Progressive Coatings VJ series, those from Buckman Labs including Busan 1218, 1420 and 1200 WB, those from Troy Corp including Polyphase 641, those from Clariant Corporation, including Sanitized TB 83-85 and Sanitized Brand T 96-21, and those from Bentech LLC including Preservor Coater 36. Others include AgION (silver zeolite) from AgION and Mircroban from Microban International (e.g. Microban additive TZ1, S2470, and PZ2). Further examples include dichloro-octyl-isothiazolone, Tri-n-butylin oxide, borax, G-4, chlorothalonil, organic fungicides, and silver-based fungicides. Any one or more of these agents would be considered satisfactory as an additive in the process of making paper material. Further commercial products may be those from AEGIS Environments (e.g. AEM 5772 Antimicrobial), from BASF Corporation (e.g. propionic acid), from Bayer (e.g. Metasol TK-100, TK-25), those from Bendiner Technologies, LLC, those from Ondei-Nalco (e.g. Nalcon 7645 and 7622), and those from Hercules (e.g. RX8700, RX3100, and PR 1912). The MSDS's of each and every commercial product mentioned above is hereby incorporated by reference in its entirety.

Still further, examples of the antimicrobial compounds may include silver zeolite, dichloro-octyl-isothiazolone, 4,5-dichloro-2-n-octyl-3(2H)-isothiazolone, 5-chloro-2-methyl-4-isothiazolin-3-one, 1,2-benzothiazol-3(2H)-one, poly [oxyethylene(ethylimino)ethylene dichloride], Tri-n-butylin oxide, borax, G-4, chlorothalonil, Alkyl-dimethylbenzyl-ammonium saccharinate, dichloropeyl-propyl-dioxolan-methyl-triazole, alpha-chlorphenyl, ethyl-dimethylethyl-trazole-ethanol, benzimidazol, 2-(thiocyanomethylthio) benzothiazole, alpha-2(-(4-chlorophenyl)ethyl)-alpha-(1-1-dimethylethyl)-1H-1,2,4-triazole-1-ethanol, (1-[[2-(2,4-dichlorophenyl)-4-propyl-1,3-dioxolan-2-yl]-methyl]-1H-1,2,4-triazole, alkyl dimethylbenzyl ammonium saccharinate, 2-(methoxy-carbamoyl)-benzimidazol, tetracholorisophthalonitrile, P-[(diiodomethyl) sulfonyl]toluol, methyl alcohol, 3-(trimethoxysilyl) propyldimethyl octadecyl ammonium chloride, chloropropyltrimethylsilane, dimethyl octadecylamine, propionic acid, 2-(4-thiazolyl)benzimidazole, 1,2-benzisothiazolin-3-one, 2-N-octyl-4-isothiazolin-3-one, diethylene glycol monoethyl ether, ethylene glycol, propylene glycol, hexylene glycol, tributoxyethyl phosphate, 2-pyridinethio-1-oxide, potassium sorbate, diiodomethyl-p-tolysulfone, citric acid, lemon grass oil, and thiocyanomethylhio-benzothiazole.

The antimicrobial compound may be present in the paper substrate at amounts from 1 to 5000 ppm dry weight, more preferably, from 100 to 3000 ppm thy weight, most preferably 50 to 1500 ppm dry weight. The amounts of antimycotic and/or fungicide may be 2, 5, 10, 25, 50, 75, 100, 12, 150, 175, 200, 225, 250, 275, 300, 325, 350, 375, 400, 425, 450, 475, 500, 600, 700, 800, 900, 1000, 1100, 1200, 1300, 1400, 1500, 1600, 1700, 1800, 1900, 2000, 2100, 2200, 2300, 2400, 2500, 2600, 2700, 2800, 2900, 3000, 3200, 3500, 3750, 4000, 4250, 4500, 4750, and 5000 ppm dry weight based upon the total weight of the paper substrate, including all ranges and subranges therein. Higher amounts of such antimycotic and/or fungicide may also prove produce an antibacterial paper material and article therefrom as well. These amounts are based upon the total weight of the paper substrate.

The paper substrate of the present invention may contain at least one sizing agent. Examples of the sizing agent may be, but is not limited to, alkaline sizing agents and acid-based sizing agents. Examples of alkaline sizing agents include without limitation unsaturated hydrocarbon compounds, such as C6 to C24, preferably C18 to C20, unsaturated hydrocarbon compounds and mixtures thereof. Examples of acid-based sizing agents include without limitation alum and rosin-based sizing agents such as Plasmine N-750-P from Pasmine Technology Inc.

Figure 2:
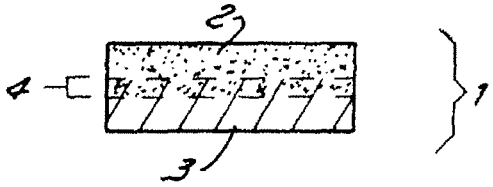
FIG. 2: A second schematic cross section of just one exemplified embodiment of the paper substrate that is included in the paper substrate of the present invention.
Figure 3:
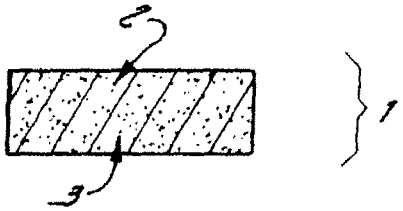
FIG. 3: A third schematic cross section of just one exemplified embodiment of the paper substrate that is included in the paper substrate of the present invention.

FIGS. 1-3 demonstrate different embodiments of the paper substrate 1 in the paper substrate of the present invention. FIG. 1 demonstrates a paper substrate 1 that has a web of cellulose fibers 3 and a composition containing an antimicrobial compound 2 where the composition containing an antimicrobial compound 2 has minimal interpenetration of the web of cellulose fibers 3. Such an embodiment may be made, for example, when an antimicrobial compound is coated onto a web of cellulose fibers during or after papermaking and/or during or after converting the substrate to a useful wallboard tape and/or during or after abrading (such as sanding) the surface of the substrate.

FIG. 2 demonstrates a paper substrate 1 that has a web of cellulose fibers 3 and a composition containing an antimicrobial compound 2 where the composition containing an antimicrobial compound 2 interpenetrates the web of cellulose fibers 3. The interpenetration layer 4 of the paper substrate 1 defines a region in which at least the antimicrobial compound penetrates into and is among the cellulose fibers. The interpenetration layer may be from 1 to 99% of the entire cross section of at least a portion of the paper substrate, including 1, 2, 5, 10, 15, 20, 25, 30, 35, 40, 45, 50, 55, 60, 65, 70, 75, 80, 85, 90, 95, and 99% of the paper substrate, including any and all ranges and subranges therein. Such an embodiment may be made, for example, when an antimicrobial compound is added to the cellulose fibers prior to a coating method and may be combined with a subsequent coating method if required. Addition points may be at the size press, for example.

FIG. 3 demonstrates a paper substrate 1 that has a web of cellulose fibers 3 and an antimicrobial compound 2 where the antimicrobial compound 2 is approximately evenly distributed throughout the web of cellulose fibers 3. Such an embodiment may be made, for example, when an antimicrobial compound is added to the cellulose fibers prior to a coating method and may be combined with a subsequent coating method if required. Exemplified addition points may be at the wet end of the paper making process, the thin stock, and the thick stock.

The web of cellulose fibers and the antimicrobial compound may be in a multilayered structure. The thicknesses of such layers may be any thickness commonly utilized in the paper making industry for a paper substrate, a coating layer, or the combination of the two. The layers do not have to be of approximate equal size. One layer may be larger than the other. One preferably embodiment is that the layer of cellulose fibers has a greater thickness than that of any layer containing the antimicrobial compound. The layer containing the cellulose fibers may also contain, in part, the antimicrobial compound.

Further examples of sizing agents that may be incorporated into the present invention may include, but is not limited to, those found in the following patents: U.S. Pat. Nos. 6,595,632, 6,512,146, 6,316,095, 6,273,997, 6,228,219, 6,165,321, 6,126,783, 6,033,526, 6,007,906, 5,766,417, 5,685,815, 5,527,430, 5,011,741, 4,710,422, and 4,184,914, which are hereby incorporated in their entirety by reference. Preferred alkaline sizing agent may be, but not limited to, alkyl ketene dimer, alkenyl ketene dimer and alkenyl succinic anhydride.

The paper substrate of the present invention may contain from 0.05 to 1.5 wt % of the alkaline sizing agent based upon the total weight of the substrate. This range includes 0.05, 0.06, 0.07, 0.08, 0.09, 0.1, 0.2, 0.3, 0.4, 0.5, 0.6, 0.7, 0.8, 0.9, 1.0, 1.1, 1.2, 1.3, 1.4, and 1.5 wt %, including any and all ranges and subranges therein.

The paper substrate of the present invention may have a MD tensile as measured by conventional TAPPI method 494 of from 25 to 100, preferably from 40 to 90 lbf/inch width. This range includes MD tensile of 25, 30, 35, 40, 45, 50, 55, 60, 65, 70, 75, 80, 85, 90, 95, and 100 lbf/inch width, including any and all ranges and subranges therein.

The paper substrate of the present invention may have a CD tensile as measured by conventional TAPPI method 494 of from 5 to 50, preferably from 20 to 50 lbf/inch width, most preferably 25 to 40 lbf/inch width. This range includes CD tensile of 5, 10, 15, 20, 25, 30, 35, 40, 45, and 50 lbf/inch width, including any and all ranges and subranges therein.

The paper substrate of the present invention may have a wet strength as measured by conventional TAPPI method 456 of from 5 to 50, preferably from 10 to 25, most preferably from 15 to 25, lb/inch width. This range includes wet strengths of 5, 10, 15, 20, 25, 30, 35, 40, 45, and 50 lb/inch width, including any and all ranges and subranges therein.

The paper substrate of the present invention may have an internal bond as measured by conventional TAPPI method 541 of from 25 to 350, preferably from 50 to 250, most preferably from 100-200, milli ft-lb/sq. in. This range includes internal bond of 25, 30, 35, 40, 45, 50, 55, 60, 65, 70, 75, 80, 85, 90, 95, 100, 110, 125, 150, 175, 200, 225, 250, 275, 300, 325 and 350 milli ft-lb/sq. in, including any and all ranges and subranges therein.

The paper substrate of the present invention may have a pH of at least about 1.0 to about 14.0 as measured by any conventional method such as a pH marker/pen and conventional TAPPI methods 252 and 529 (hot extraction test and/or surface pH test). The pH of the paper may be from about 1.0 to 14.0, preferably about 4.0 to 9.0, most preferably from about 6.5 to 8.5. This range includes pHs of 1.0, 2.0, 3.0, 4.0, 5.0, 6.0 6.5, 6.6, 6.7, 6.8, 6.9, 7.0, 7.1, 7.2, 7.3, 7.4, 7.5, 7.6, 7.7, 7.8, 7.9, 8.0, 8.1, 8.2, 8.3, 8.4, 8.5, 8.6, 8.7, 8.8, 8.9, 9.0, 9.2, 9.4, 9.5, 9.6, 9.8, 10.0, 10.5, 11.0, 11.5, 12.0, 12.5, 13.0, 13.5, and 14.0, including any and all ranges and subranges therein.

The density, basis weight and caliper of the web of this invention may vary widely and conventional basis weights, densities and calipers may be employed depending on the paper-based product formed from the web.

The paper substrate according to the present invention may be made off of the paper machine having a basis weight of from 50 lb/3000 sq. ft. to 120 lb/3000 sq. ft, preferably from 70 to 120, and most preferably from 80-100 lb/3000 sq. ft. The basis weight of the substrate may be 50, 52, 54, 55, 56, 58, 60, 62, 64, 65, 66, 68, 70, 72, 74, 75, 76, 78, 80, 82, 84, 85, 86, 88, 90, 92, 94, 95, 96, 98, 100, 105, 110, 115 and 120 lb/3000 sq. ft, including any and all ranges and subranges therein.

The paper substrate according to the present invention may be made off of the paper machine having an apparent density of from 5.0 to 20.0, preferably 9.0 to 13.0, most preferably from 9.5 to 11.5, lb/3000 sq. ft. per 0.001 inch thickness. The apparent density of the substrate may be 5.0, 5.2, 5.4, 5.5, 5.6, 5.8, 6.0, 6.2, 6.4, 6.5, 6.6, 6.8, 7.0, 7.2, 7.4, 7.5, 8.0, 8.5, 9.0, 9.5, 10.0, 10.5, 11.0, 11.5, 12.0, 12.5, 13.0, 13.5, 14.0, 14.5, 15.0, 15.5, 16.0, 16.5, 17.0, 17.5, 18.0, 18.5, 19.0, 19.5 and 20.0 lb/3000 sq. ft. per 0.001 inch thickness, including any and all ranges and subranges therein.

The paper substrate according to the present invention may have a width off the winder of a paper machine of from 5 to 100 inches and can vary in length. The width of the paper substrate may be 5, 10, 15, 20, 25, 30, 35, 40, 45, 50, 55, 60, 65, 70, 75, 80, 85, 90, 95, 100 inches, including any and all ranges and subranges therein.

Additionally, the paper substrate according to the present invention may be cut into streamers that have a width of from 1.5 to 3.25 inches wide and may vary in length. The width of the paper substrate streamer may have a width of 1.50, 1.60, 1.70, 1.75, 1.80, 1.85, 1.9, 1.95, 2.00, 2.10, 2.20, 2.30, 2.40, 2.50, 2.60, 2.70, 2.80, 2.90, 3.00, 3.05, 3.10, 3.15, 3.20, and 3.25 inches, including any and all ranges and subranges therein.

The paper substrate of the present invention may contain optional components as well including but not limited to binders, wet strength additives, and anionic promoters.

One optional component that is included as one embodiment of the paper substrate of the present invention includes without limitation a binder. Examples of binders include, but are not limited to, polyvinyl alcohol, Amres (a Kymene type), Bayer Parez, polychloride emulsion, modified starch such as hydroxyethyl starch, starch, polyacrylamide, modified polyacrylamide, polyol, polyol carbonyl adduct, ethanedial/polyol condensate, polyimide, epichlorohydrin, glyoxal, glyoxal urea, ethanedial, aliphatic polyisocyanate, isocyanate, 1,6 hexamethylene diisocyanate, diisocyanate, polyisocyanate, polyester, polyester resin, polyacrylate, polyacrylate resin, acrylate, and methacrylate. When the substrate of the present invention contains a binder, preferable binders include without limitation starch and polyvinyl alcohol.

When the substrate of the present invention contains a binder, the substrate may include any amount of binder including less than 5% of binder, This range includes less than 0.001, 0.002, 0.005, 0.006, 0.008, 0.01, 0.02, 0.03, 0.04, 0.05, 0.1, 0.2, 0.4, 0.5, 0.6, 0.7, 0.8, 0.9, 1, 2, 4, and 5 wt % based on the total weight of the substrate, including any and all ranges and subranges therein.

One optional component that is included as one embodiment of the paper substrate of the present invention includes without limitation a wet strength additive. The paper substrate of the present invention may contain at least one wet strength additive. The wet strength additive may be cationic, anionic, neutral, and amphoteric. A preferred wet strength additive is cationic and/or contains a basic functional group. Examples of the wet strength additive may be, but is not limited to, polymeric amine epichlorohydrin (PAE), urea formaldehyde, melamine formaldehyde and glyoxylated polyacrylamide resins. Further examples of wet strength additives that may be incorporated in to the present invention may include, but is not limited to, those found in the following patents: U.S. Pat. Nos. 6,355,137 and 6,171,440, which are hereby incorporated in their entirety by reference. Preferred wet strength additives include, but are not limited to, polymeric amine epichlorohydrin (PAE).

The paper substrate of the present invention may contain from 0.25 to 2.5 wt % of the wet strength additive based upon the total weight of the substrate. This range includes 0.25, 0.30, 0.35, 0.40, 0.45, 0.50, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4 and 2.5 wt %, including any and all ranges and subranges therein.

One optional component that is included as one embodiment of the paper substrate of the present invention includes without limitation an anionic promoter. The paper substrate of the present invention may contain at least one anionic promoter. Examples of the anionic promoter may be, but is not limited to, polyacrylates, sulfonates, carboxymethyl celluloses, galactomannan hemicelluloses and polyacrylamides. Preferred anionic promoters include, but are not limited to polyacrylates such as Nalco 64873.

The paper substrate of the present invention may contain from 0.05 to 1.5 wt % of the anionic promoter based upon the total weight of the substrate. This range includes 0.05, 0.06, 0.07, 0.08, 0.09, 0.1, 0.2, 0.3, 0.4, 0.5, 0.6, 0.7, 0.8, 0.9, 1.0, 1.1, 1.2, 1.3, 1.4, and 1.5 wt %, including any and all ranges and subranges therein.

The paper substrate of the present invention may also optionally include inert substances including without limitation fillers, thickeners, and preservatives. Other inert substances include, but are not limited to silicas such as colloids and/or sols. Examples of silicas include, but are not limited to, sodium silicate and/or borosilicates. Another example of inert substances is solvents including but not limited to water. Examples of fillers include, but are not limited to; calcium carbonate, calcium sulfate hemihydrate, and calcium sulfate dehydrate. A preferable filler is calcium carbonate.

The paper substrate of the present invention may contain from 0.001 to 20 wt % of the inert substances based on the total weight of the substrate, preferably from 0.01 to 10 wt %, most preferably 0.1 to 5.0 wt %, of each of at least one of the inert substances. This range includes 0.001, 0.002, 0.005, 0.006, 0.008, 0.01, 0.02, 0.03, 0.04, 0.05, 0.1, 0.2, 0.4, 0.5, 0.6, 0.7, 0.8, 0.9, 1, 2, 4, 5, 6, 8, 10, 12, 14, 15, 16, 18, and 20 wt % based on the total weight of the substrate, including any and all ranges and subranges therein.

The paper substrate may be made by contacting a plurality of cellulose fibers with a antimicrobial compound and/or a sizing agent consecutively in any order and/or simultaneously. Further, the contacting may occur in an aqueous environment having a pH of from about 1.0 to about 14.0, preferably from about 6.8 to about 8.5. The pH may be 1.0, 2.0, 3.0, 4.0, 5.0, 6.0 6.5, 6.6, 6.7, 6.8, 6.9, 7.0, 7.1, 7.2, 7.3, 7.4, 7.5, 7.6, 7.7, 7.8, 7.9, 8.0, 8.1, 8.2, 8.3, 8.4, 8.5, 8.6, 8.7, 8.8, 8.9, 9.0, 9.2, 9.4, 9.5, 9.6, 9.8, 10.0, 10.5, 11.0, 11.5, 12.0, 12.5, 13.0, 13.5, and 14.0, including any and all ranges and subranges therein. Accordingly the paper substrate may be made using acidic, near neutral, neutral, or alkaline conditions.

Still further, the contacting may occur at acceptable concentration levels that provide the paper substrate of the present invention to contain any of the above-mentioned amounts of cellulose fibers, antimicrobial compound, sizing agent, optional components, and/or inert substances isolated or in any combination thereof. The contacting may occur anytime in the papermaking process including, but not limited to the thick stock, thin stock, head box, size press, water box, and coater. The cellulose fibers, antimicrobial compound, sizing agent, optional components, and/or inert substances may be contacted serially, consecutively, and/or simultaneously in any combination with each other. The cellulose fibers, antimicrobial compound, sizing agent, optional components, and/or inert substances may be pre-mixed in any combination before addition to the paper-making process.

These methods of making the paper substrate of the present invention may be added to any conventional papermaking processes, as well as converting processes, including abrading or sanding to create a fine nap for greater adhesion qualities, slitting, scoring, perforating, sparking, calendaring, sheet finishing, converting, coating, laminating, printing, etc. Preferred conventional processes include those tailored to produce paper substrates capable to be utilized as wallboard tape. Textbooks such as those described in the "Handbook for pulp and paper technologists" by G. A. Smook (1992), Angus Wilde Publications, describe such processes and is hereby incorporated, in its entirety, by reference.

In one embodiment, the cellulosic fibers and sizing agent may be contacted at anytime during papermaking with or without optional substances or inert substances. In such an embodiment, the cellulosic fibers and sizing agent are contacted at least at the wet end of the paper machine, then the web is dried to make a paper substrate suitable for use as wallboard tape. Optional substances and/or inert substances may optionally be added at anytime during papermaking including without limitation optionally adding the binder to the web using a size press. The substrate may be sanded creating a nap, preferably a fine nap, for greater adhesion qualities. The surface of the substrate carrying the nap may then be contacted with the antimicrobial compound. The contacting may occur using a size press or any coater apparatus including without limitation a spray coater apparatus. Within this embodiment, the optional components and/or inert substances may optionally be contacted with the surface of the substrate at the same time as the antimicrobial compound.

The present invention is explained in more detail with the aid of the following embodiment example which is not intended to limit the scope of the present invention in any manner.

EXAMPLES

Example 1

Materials

Handsheet Furnish: 100% refined southern softwood collected on Jul. 20, 2007
Sizing Agent: Plasmine N-750-P (40% solids)
Aluminum Sulfate (Alum): (40% consistency)
Wet Strength Agent: Poly(amido-amine)-epichlorohydrin (25% solids)
Antimicrobial Agent (A/M): Intace B350
Starch: Tate & Lyle Pearl
Antimicrobial Gypsum Board: ½" Dense Armor Plus Mold & Humidity Resistant gypsum panel from Georgia Pacific
Joint Compound: Ready Mixed Sheetrock All Purpose Joint Compound from US Gypsum Method:

Two Dynamic Sheet Former (DSF) handsheets were made according to the following experimental design:

TABLE 1

DSF Study for paper substrates for use as antimicrobial wallboard tape
Design:

| I.D. | Liquid Sizing lb/T | Alum lb/T | Wet Strength lb/T | Surface Sizing (Starch) | A/M* Agent | DSF BDBW Target gsm |
|---|---|---|---|---|---|---|
| A | 0 | 20 | 12 | N | N | 131.5 |
| B | 0 | 20 | 12 | N | Y | 131.5 |
| C | 10 | 20 | 12 | N | N | 131.5 |
| D | 10 | 20 | 12 | N | Y | 131.5 |
| E | 0 | 20 | 12 | Y | N | 125.0 |
| F | 0 | 20 | 12 | Y | Y | 125.0 |
| G | 10 | 20 | 12 | Y | N | 125.0 |
| H | 10 | 20 | 12 | Y | Y | 125.0 |

Due to the size of the wet-press felt, all sheets were divided into thirds and then wet-pressed at a pressure of 40 psi before drying on a rotary drum-dryer.

All sheets were tested for the following physical properties prior to any surface sizing with starch: Basis Weight (TAPPI T-410), Caliper (TAPPI T-411), Gurley Porosity (TAPPI T-460), and HST with 10% formic acid and dye solution (TAPPI T-530).

Samples E-H were then run through a bench-top puddle size press using the Pearl Starch and dried on a drum-dryer. The pearl starch was cooked in two batches having solids measuring 16.7% and 16.3% yielding an approximate pick up of 110 #/Ton.

Sheets for samples E-H were tested again for the same physical properties as before. All sheets for samples A-H were manually sanded using a belt sander and 80 grit sand paper.

Samples B, D, F, and H were manually dipped in a bath of Intace B350 anti-michotic agent to yield an approximate pick up of 2 #/Ton. Then each sheet for those samples was dried on a drum-dryer.

Samples from each condition A-H were cut into 1" wide tape strips. Then they were adhered to 3"×3" squares of anti-microbial gypsum board using joint compound and allowed to air dry.

Figure 4:
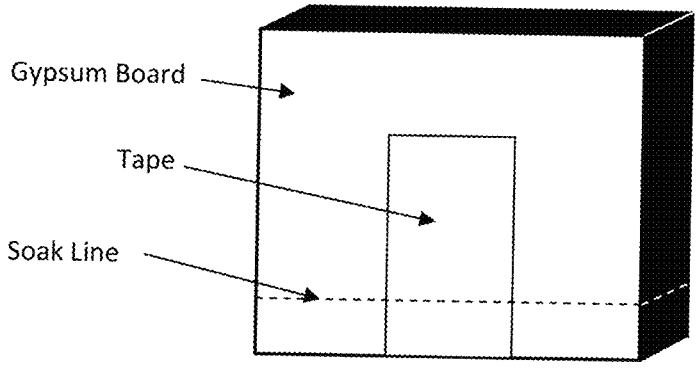
FIG. 4: A first pictorial representation of how wallboard and tape samples were tested for antimicrobial performance according to Example 1.

Prior to inoculation, 3 samples from each condition (A-H) were soaked in ½" of sterile water for 1 hour. Each gypsum board square was placed upright on its edge so that the water comes ½ " up the side of the square that has the tape touching the edge as indicated in FIG. 4.

Figure 5:
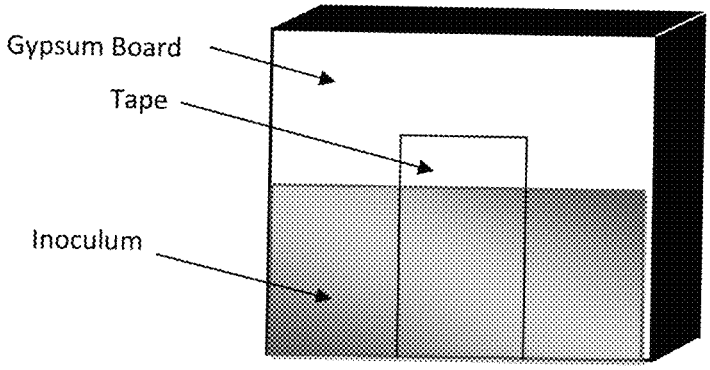
FIG. 5: A second pictorial representation of how wallboard and tape samples were tested for antimicrobial performance according to Example 1.
Figure 6:
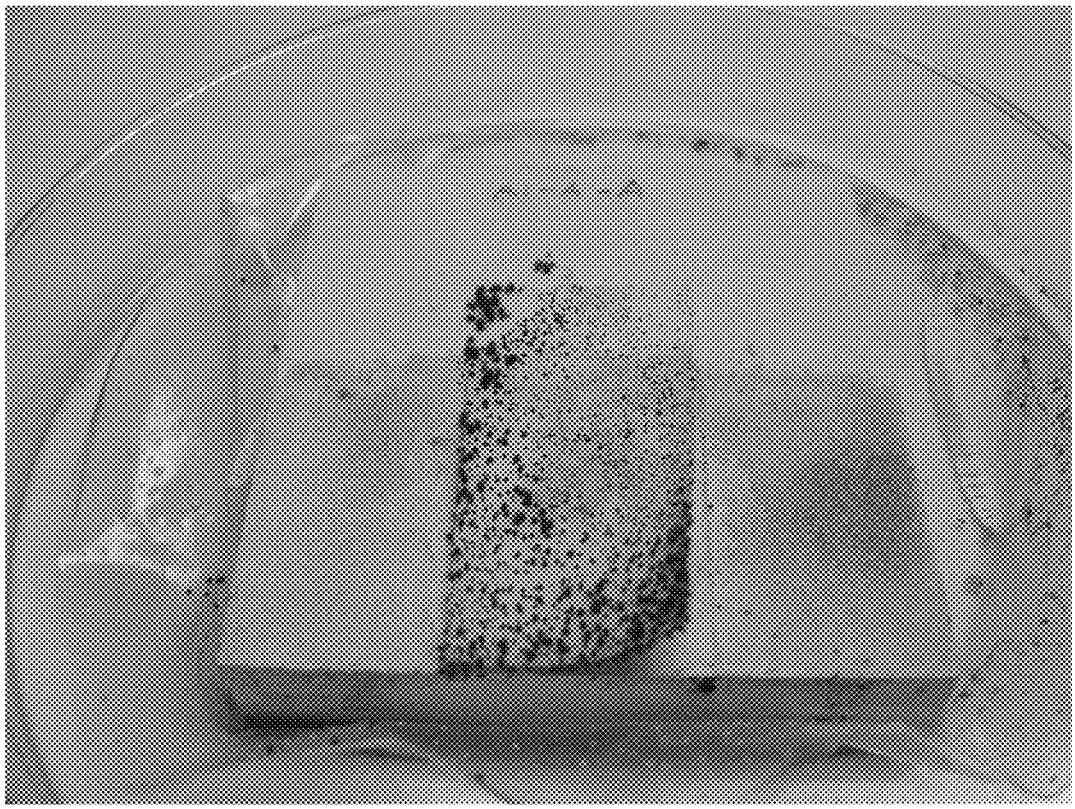
FIG. 6: A photograph showing the antimicrobial performance of Sample A after 62 days as measured by the process of Example 1.
Figure 7:
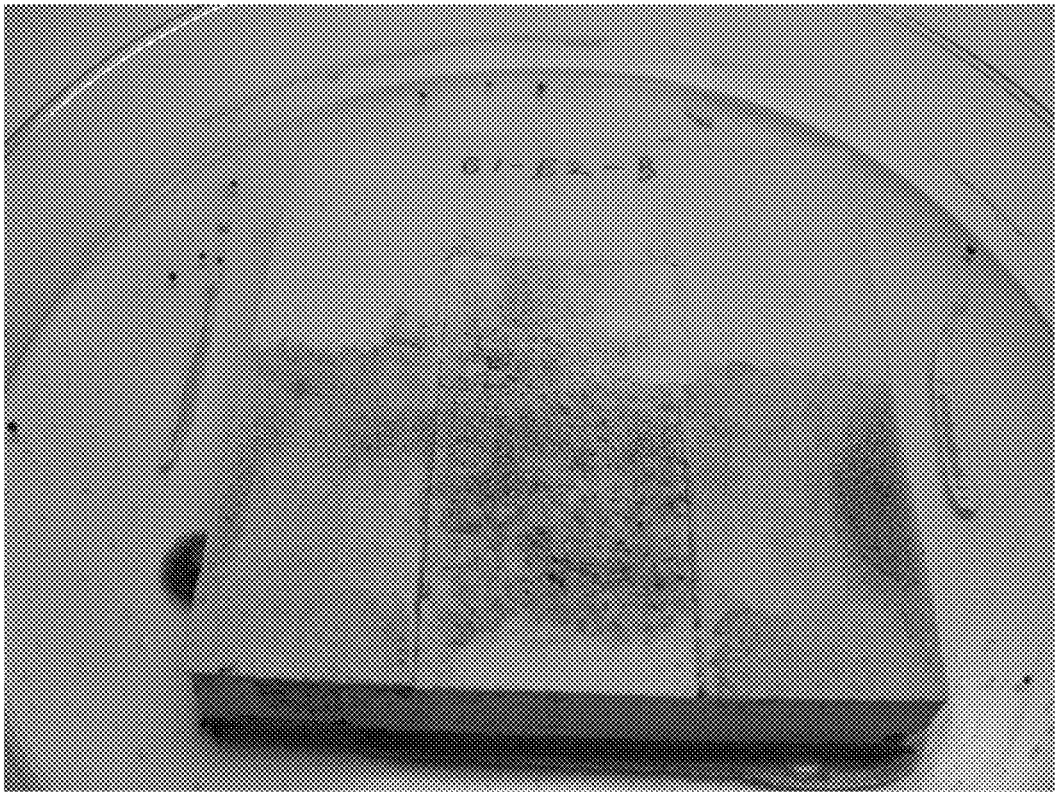
FIG. 7: A photograph showing the antimicrobial performance of Sample B after 62 days as measured by the process of Example 1.
Figure 8:
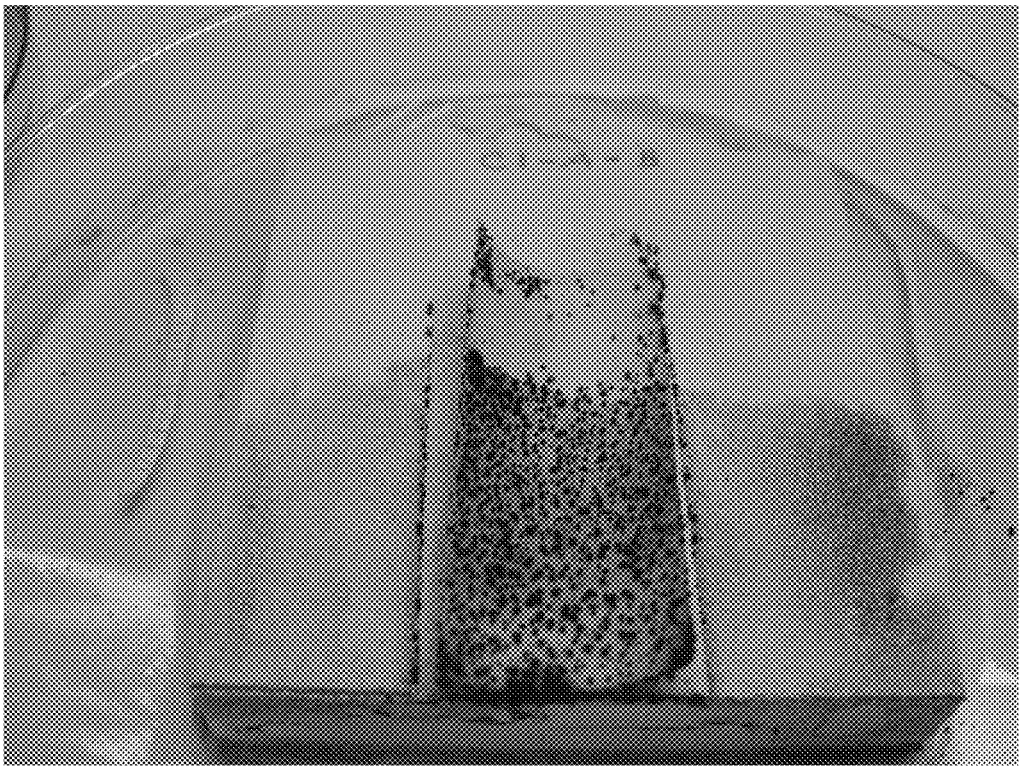
FIG. 8: A photograph showing the antimicrobial performance of Sample C after 62 days as measured by the process of Example 1.
Figure 9:
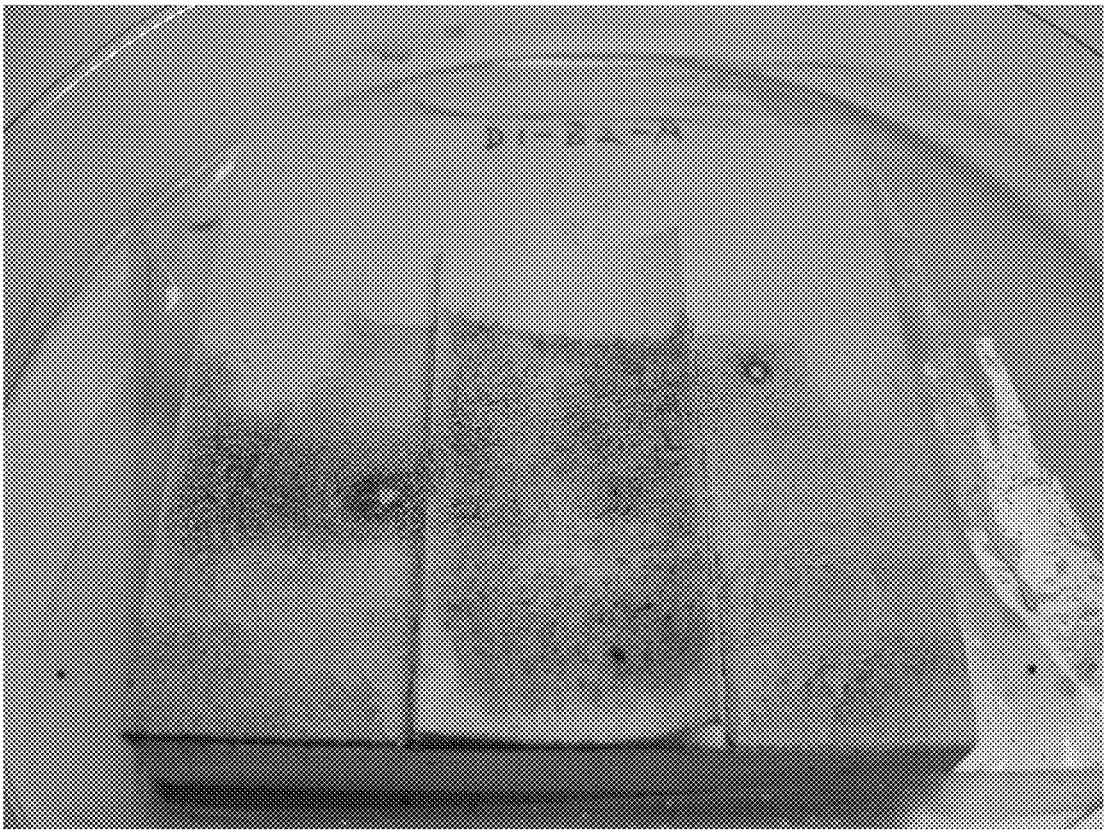
FIG. 9: A photograph showing the antimicrobial performance of Sample D after 62 days as measured by the process of Example 1.
Figure 10:
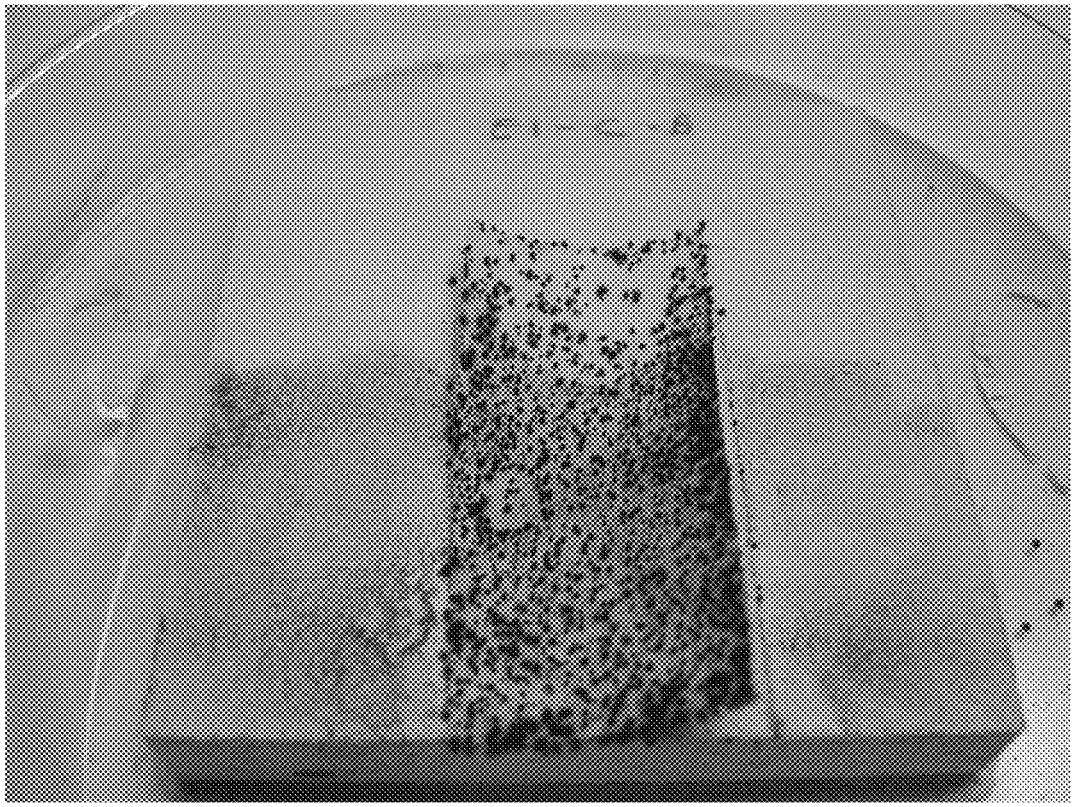
FIG. 10: A photograph showing the antimicrobial performance of Sample E after 62 days as measured by the process of Example 1.
Figure 11:
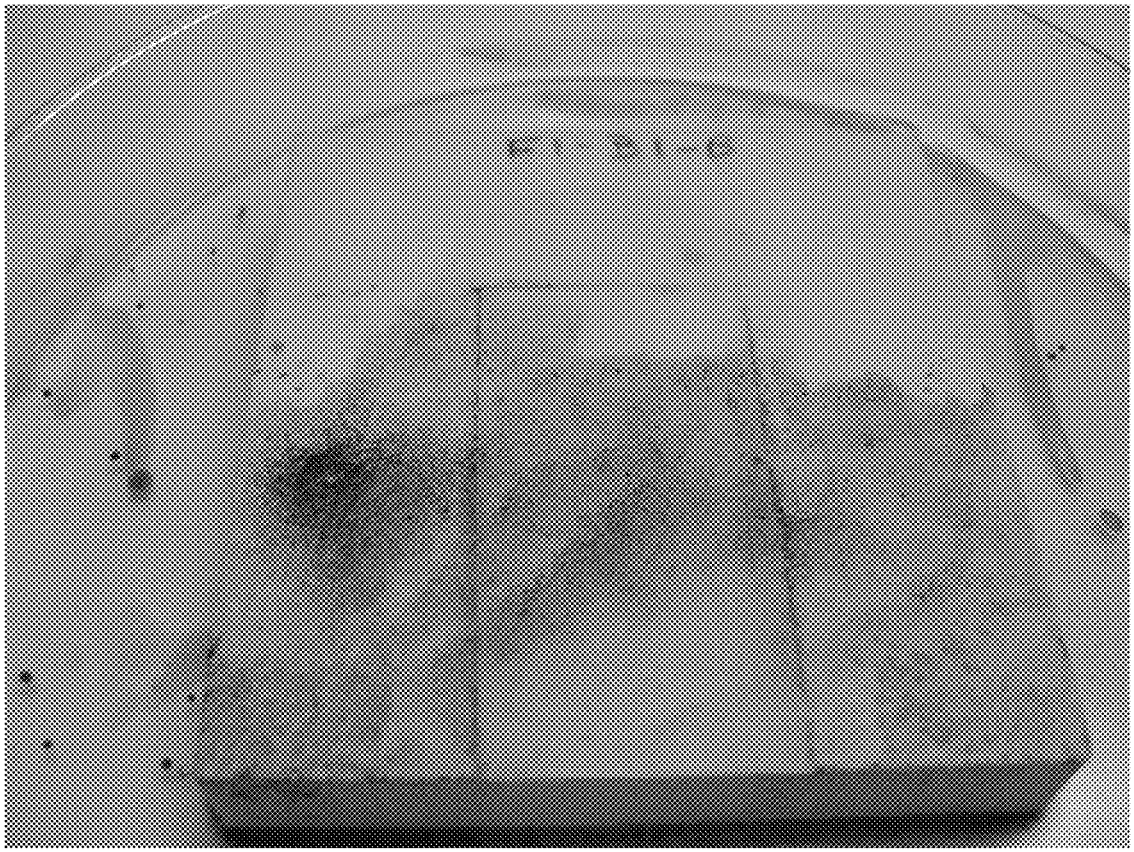
FIG. 11: A photograph showing the antimicrobial performance of Sample F after 62 days as measured by the process of Example 1.
Figure 12:
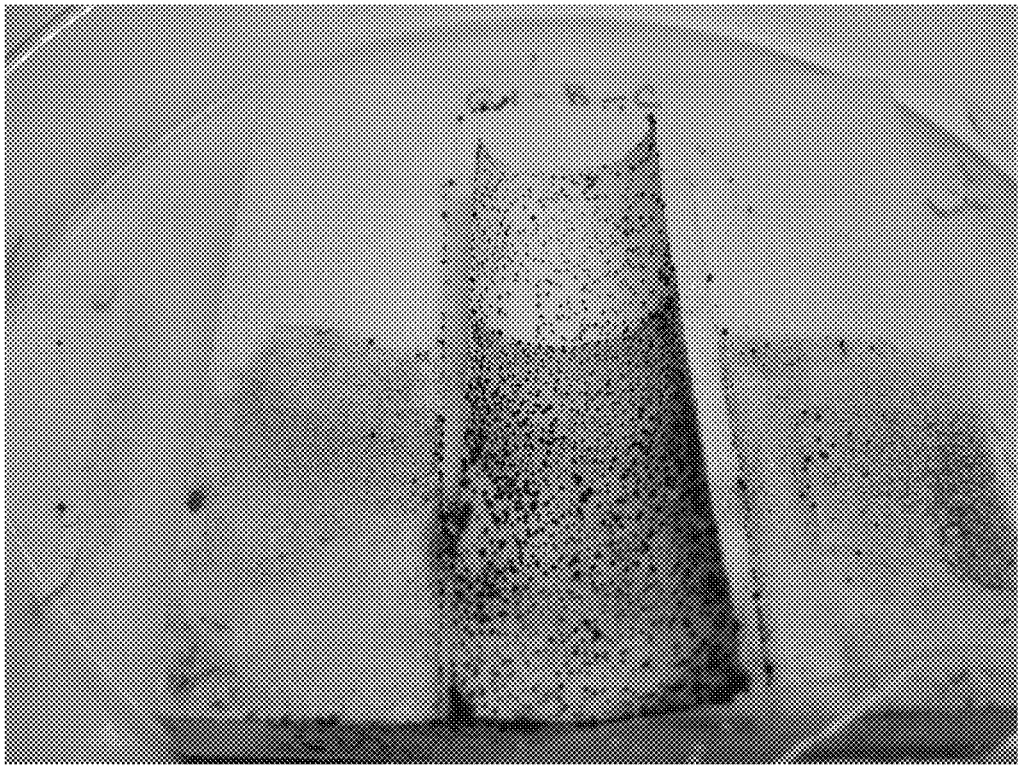
FIG. 12: A photograph showing the antimicrobial performance of Sample G after 62 days as measured by the process of Example 1.
Figure 13:
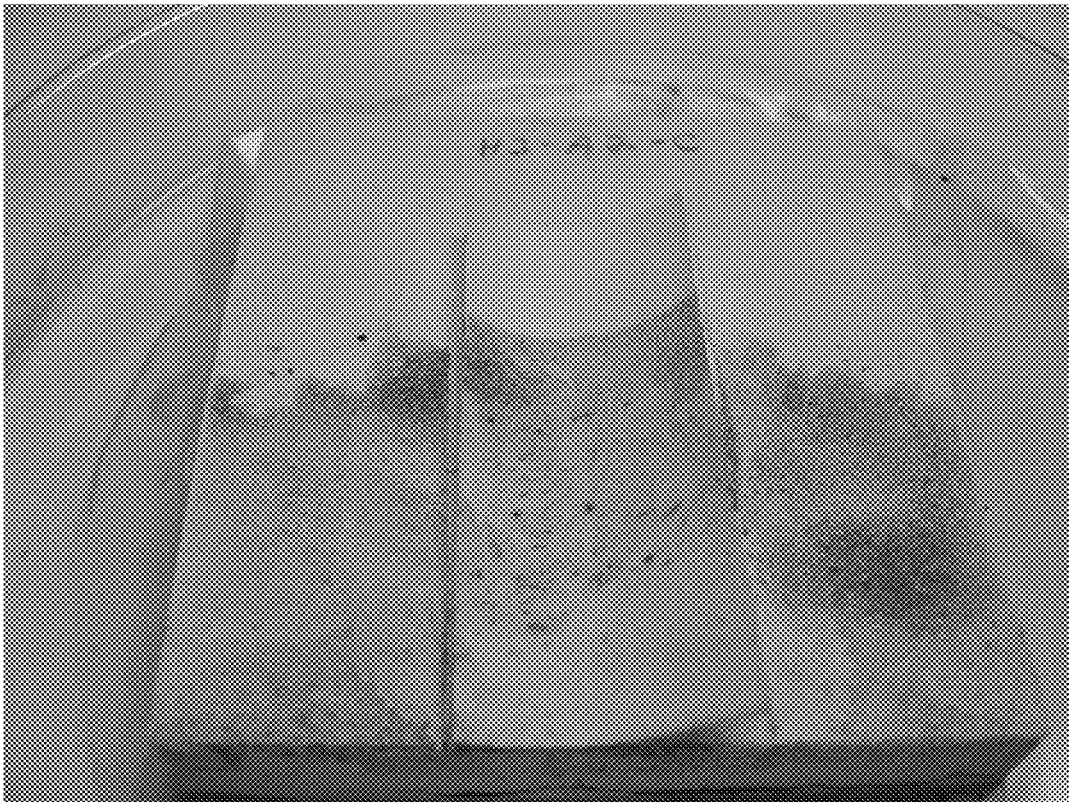
FIG. 13: A photograph showing the antimicrobial performance of Sample H after 62 days as measured by the process of Example 1.

Sample squares were placed on 150×25 mm agar plates and inoculated with 0.38 mL of inoculum containing *Chaetomium globosum, Aspergillus terreus*, and *Aspergillus niger*. The inoculum was spread along the bottom half of the sample square (as seen in FIG. 5), allowing a portion of the tape to remain uninoculated.

There was also a set of additional tape samples (A-H) that were not bonded to gypsum panels that corresponded to each gypsum board specimen that was tested. The tape was exposed to water in the same manner as the gypsum board samples, but for 2 minutes instead of 1 hour. They were then inoculated over their entire surface with 0.25 mL of the inoculum.

Growth observations for all samples were recorded at 7, 21, 33, and 62 days after the samples were inoculated. Photographs of a representative sample for each condition were taken on or near each observation date.

An amended*form of ASTM Method D2020-92 Standard Test Methods for Mildew (Fungus) Resistance of Paper and Paperboard was followed. The amendments included 1) The test substances were wallboard pieces (i.e. gypsum board square) measuring 3 inches by 3 inches (see above and in FIG. 4).
2) Prior to inoculation, each wallboard piece was exposed to a ½ inch of sterile water for 1 hour. The test substance pieces were placed on their edge upright so that the water comes ½ inch up the side of the piece that has the tape touching the edge (see FIG. 5).
3) After exposure to the water, the test substances pieces were placed on the 150×25 mm agar plates.
4) Each replicate was inoculated with 0.38 mL of the inoculums. The inoculums were spread along the bottom half of the wallboard piece, the bottom being the edge that was immersed. This will allowed a portion of the tape to remain uninoculated.
5) For each wallboard piece, there was a corresponding separate piece of tape. The tape was exposed to the water in the same manner as the wallboard for 2 minutes. The tape pieces were inoculated over their entire surface with 0.25 mL of the inoculums.

Results;

Summary (Observations Until Day 33)

A/M Treatment—Application hinders mold growth from day 7 to 33 in all but one sample (Sample F).

Starch Content—Mold growth differences in samples with and without starch in them were not noted until day 33. There is a visual difference on day 20: Samples with starch had noticeably more and larger spore clusters than samples without.

Sizing Content—Mold growth was noticeably smaller in spore size and cluster amounts on samples where sizing was present.

Growth with Increasing Time—For samples with mold growth, regardless of starch or sizing content, sporulation mostly began on the edges of the tape by the first observation day (7 days after inoculation). By the second observation day (21 days after inoculation), mold growth had spread across the surface of the tape.

Time-Specific Observations

Day 7 Observations

All samples that contain the a/m application show no growth—a/m agent has an effect in prohibiting growth of mold.

Most growth initiated at the tape edge for samples where slight growth was noted.

At this stage of growth sizing and starch content do not appear to have an effect on mold growth due to the fact that replicates where "heavy" growth was noted in the "soaked" portion of the sample had sizing in one and no sizing in the other.

Most samples did not have growth past the inoculation site.

Day 21 Observations

Growth began to occur in the non-inoculated region where water "wicked" up the drywall portion of the sample during the soaking portion of sample prep.

Sizing still does not seem to hinder mold growth at this stage since occurrences of "heavy" growth appeared on samples with and without sizing. The effects of the content of starch are still not seen at this point either because the "heavy" mold growth appeared on samples with and without starch in them.

All samples that contain the a/m application still show no growth with the exception of sample F (no starch, no sizing, with a/m). This particular sample is believed to be an outlier. Two replicates for this sample had mold growth on the dry portion of the non-inoculated drywall.

Growth is now seen on the surface of all samples that show growth, not just the edge of the tape.

Day 33 Observations

Still no growth on the samples with the a/m treatment.

Most reps have the same mold coverage as day 21 results.

Additional mold growth is noted along the edge of the inoculated portion of the tape on samples containing starch but no a/m treatment.—effect of added nutrients (aka starch) now visible.

Day 62 Observations—

A/M Treatment—all samples show no growth on the tape itself. Sample F (with starch, no sizing, with a/m) has very slight growth on the drywall above the inoculation point only for two of three reps. No other a/m treated samples have growth anywhere on them.

Starch Content—For those samples without starch, sporadic mold growth is noted above the inoculation point. Samples that contain starch have evenly spread growth above the inoculation point with slightly larger spores below the inoculation point.

Sizing Content—Samples without sizing show consistent growth above and below the inoculation point. Samples with sizing show growth mostly confined to the inoculation area.

As used throughout, ranges are used as a short hand for describing each and every value that is within the range, including all subranges therein.

Numerous modifications and variations on the present invention are possible in light of the above teachings. It is, therefore, to be understood that within the scope of the accompanying claims, the invention may be practiced otherwise than as specifically described herein.

All of the references, as well as their cited references, cited herein are hereby incorporated by reference with respect to relative portions related to the subject matter of the present invention and all of its embodiment

What is claimed is:

1. A wallboard joint tape, comprising
a web of cellulosic fibers;
at least one antimicrobial compound;
at least one acid-based sizing agent; and
optionally starch; wherein
polyvinyl alcohol is not present;
the antimicrobial compound is present at an amount ranging from about 10 ppm to about 5,000 ppm;
the sizing agent comprises a combination of alum and rosin-based sizing agent and is present at an amount ranging from about 0.5 to about 1.5 wt %; and
the starch is present at an amount ranging from 0.0% to not more than about 5%.

2. The tape according to claim 1, further comprising at least one surface that is abraded.

3. The tape according to claim 1, said tape having:
a basis weight ranging from 50 to 120 lb per 3,000 sq. ft.;
a cross-direction Tensile ranging from 5 to 50 lbf/inch width as measured by Tappi Test Method T 494 om-06; and
a thickness ranging from 0.006 to 0.012 inch thickness as measured by Tappi Test Method T 411 om-05.

4. The tape according to claim 1, wherein said sizing agent is present within the web and the antimicrobial compound is present at the surface of the web.

5. The tape according to claim 4, wherein said surface of the web has a nap thereon.

6. The tape according to claim 1, which has a pH of 1.0 to 6.9.

7. A method, comprising contacting a paper substrate comprising a web of cellulosic fibers with an acid-based sizing agent and an antimicrobial compound, and optionally starch, to produce a wallboard joint tape, comprising
a web of cellulosic fibers;
at least one antimicrobial compound;
at least one acid-based sizing agent; and
optionally starch; wherein
polyvinyl alcohol is not present;
the antimicrobial compound is present at an amount ranging from about 10 ppm to about 5,000 ppm;
the sizing agent comprises a combination of alum and rosin-based sizing agent and is present at an amount ranging from about 0.5 to about 1.5 wt %; and
the starch is present at an amount ranging from 0.0% to not more than about 5%.

8. The method according to claim 7, further comprising abrading or sanding a surface of said web.

9. The method according to claim 7, further comprising abrading or sanding a surface of said web prior to said contacting.

10. The method according to claim 9, wherein said contacting comprises contacting said antimicrobial compound with said surface of said web.

11. The method according to claim 10, wherein said contacting said web with said antimicrobial compound is performed using a size press, a coater, or a sprayer.

12. The method according to claim 7, wherein said contacting said web with said antimicrobial compound is performed using a size press, a coater, or a sprayer.

13. The method according to claim 7, wherein the tape has a pH of 1.0 to 6.9.

14. A method of reducing, inhibiting, preventing, stalling, and/or retarding the growth of mold or fungus on a wallboard, comprising bonding the tape according to claim 1 to said wallboard.

15. The method according to claim 14, further comprising abrading or sanding a surface of said tape.

16. The method according to claim 14, further comprising abrading or sanding a surface of said tape prior to said bonding.

17. The method according to claim 14, wherein the tape has a pH of 1.0 to 6.9.

18. A composition comprising,
wallboard or gypsum board;
joint compound; and
wallboard joint tape comprising
a web of cellulosic fibers;
at least one antimicrobial compound;
at least one acid-based sizing agent; and
optionally starch; wherein
polyvinyl alcohol is not present;
the antimicrobial compound is present at an amount ranging from about 10 ppm to about 5,000 ppm;
the sizing agent comprises a combination of alum and rosin-based sizing agent and is present at an amount ranging from about 0.5 to about 1.5 wt %; and
the starch is present at an amount ranging from 0.0% to not more than about 5%.

19. The method according to claim 7, further comprising bonding the tape to a wallboard with joint compound, and finishing.

20. The method according to claim 19, wherein said wallboard tape reduces, inhibits, prevents, stalls, and/or retards the growth of mold or fungus on said wallboard.

21. The method according to claim 7, wherein said contacting occurs by spraying the said starch, sizing agent, and/or antimicrobial compound directly onto at least one surface of the web.

22. The composition according to claim 18, wherein the tape has a pH of 1.0 to 6.9.

* * * * *